US006230926B1

(12) United States Patent
Schafer et al.

(10) Patent No.: US 6,230,926 B1
(45) Date of Patent: May 15, 2001

(54) TICKET COUNTING DISPENSER WITH TICKET DISPENSING ASSEMBLY

(75) Inventors: Christopher E. Schafer, Adair; Ryan B. Gruhn, Atlantic, both of IA (US)

(73) Assignee: Schafer Systems Inc., Adair, IA (US)

( * ) Notice: Subject to any disclaimer, the term of this patent is extended or adjusted under 35 U.S.C. 154(b) by 0 days.

(21) Appl. No.: 09/599,312

(22) Filed: Jun. 22, 2000

(51) Int. Cl.[7] ..... G07F 11/00
(52) U.S. Cl. ..... 221/7; 225/100
(58) Field of Search ..... 221/2, 7, 13, 9, 221/25, 26; 225/100, 96, 16, 93

(56) References Cited

U.S. PATENT DOCUMENTS 5,803,308 * 9/1998 Rong ..... 221/7

* cited by examiner

*Primary Examiner*—Kenneth W. Noland
(74) *Attorney, Agent, or Firm*—G. Brian Pingel

(57) ABSTRACT

A storage, display and dispensing apparatus for tickets of various sizes. The dispensing apparatus includes a bin housing for storing a pack of tickets, a ticket dispensing assembly through which the tickets are dispensed and a piezo electric sensing element employed to sense perforations between the tickets as they pass through the dispensing assembly.

11 Claims, 15 Drawing Sheets

TICKET COUNTING DISPENSER WITH TICKET DISPENSING ASSEMBLY

BACKGROUND OF THE INVENTION

1. Field of the Invention

The present invention relates in general to apparatus for the display and dispensing of lottery tickets and more specifically to such apparatus that has the ability for counting the lottery tickets that are dispensed and maintaining a record thereof.

2. Description of the Prior Art

Numerous states throughout the United States have implemented a variety of lottery games as a generating means of additional revenue for the state. One of the more popular types of lottery games that are offered is what are commonly referred to as instant lottery games. Tickets for instant lottery games are preprinted and upon their purchase, the purchaser can determine relatively quickly whether they are a winner of a prize.

Lottery tickets are sold in a variety of retail establishments and are commonly found in grocery stores and convenience stores. Lottery tickets in many cases are dispensed manually by the simple process of detaching a ticket or tickets from a ticket pack, according to the requirements of the ticket purchaser. However, with a variety of different types of instant lottery games now being offered it has become common place for establishments selling such tickets to use different types of ticket display and dispensing devices for the tickets.

The retailer who sells a lottery ticket receives only a small portion of the ticket price. Accordingly, it is highly important for the retailer to accurately account for each ticket that is received and sold. Most common ticket display and dispensing devices on the market today do not provide the ability to in any way keep track of the tickets that are dispensed therefrom and it is necessary for the retailers using such devices to utilize manual accounting systems for keeping track of tickets that are sold from their establishments.

As a means of providing an efficient and effective device for the dispensing and accounting of lottery tickets that are sold, various types of lottery ticket vending machines have been developed as disclosed in U.S. Pat. No. 5,383,572; 3,978,958; 4,982,337; and 5,222,624. Although such vending devices appear to be highly efficient in dispensing and accounting for the lottery tickets sold, they are expensive to purchase, are relatively complex to operate and maintain, and take up more space than is normally available for ticket dispensing devices.

Several companies have just recently begun advertising and offering new types of ticket vending devices that are used as a means for maintaining an accurate accounting of the tickets dispensed. Both Interlott Technologies, Inc. and On-point Technology Systems, Inc. now offer such display and vending devices. The present invention is an alternative to the type of devices offered by Interlott Technologies and On-point Technology Systems and is designed to provide a relatively inexpensive but highly efficient means for accurately maintaining a count of those lottery tickets that are dispensed at a particular retail establishment.

SUMMARY OF THE INVENTION

The present invention provides for the storage, display and dispensing of various types of tickets, preferably lottery tickets, and to account for tickets dispensed from the apparatus. The ticket dispensing apparatus of the present invention includes a bin housing for storing a pack of tickets, a tear bar bin assembly through which the tickets are dispensed from the bin housing and first and second ticket counting means associated with a tear bar bin assembly for providing an accurate count of the tickets dispensed from the apparatus.

The first ticket counting means is associated with the tear bar assembly and is in the form of a friction wheel that presses against the tickets as they pass through such assembly and provides electronic signals representative of the number of tickets passing therethrough. The tickets to be dispensed by the instant invention are sequentially connected together by perforated joinder lines. The second ticket counting means is also associated with the tear bar bin assembly and is adapted to sense the perforations of the tickets as they pass through such assembly to provide a ticket sensing signal that increases the accuracy of the first counting means. In this way, the accuracy of the dispensing apparatus is significantly improved so that the apparatus provides a highly cost efficient means for achieving an accurate ticket dispensing count.

Other objects, features, and advantages of the present invention will be readily appreciated as the same becomes better understood after reading the subsequent description taken in conjunction with the appendant drawings.

DETAILED DESCRIPTION OF THE PREFERRED EMBODIMENT

Figure 1:
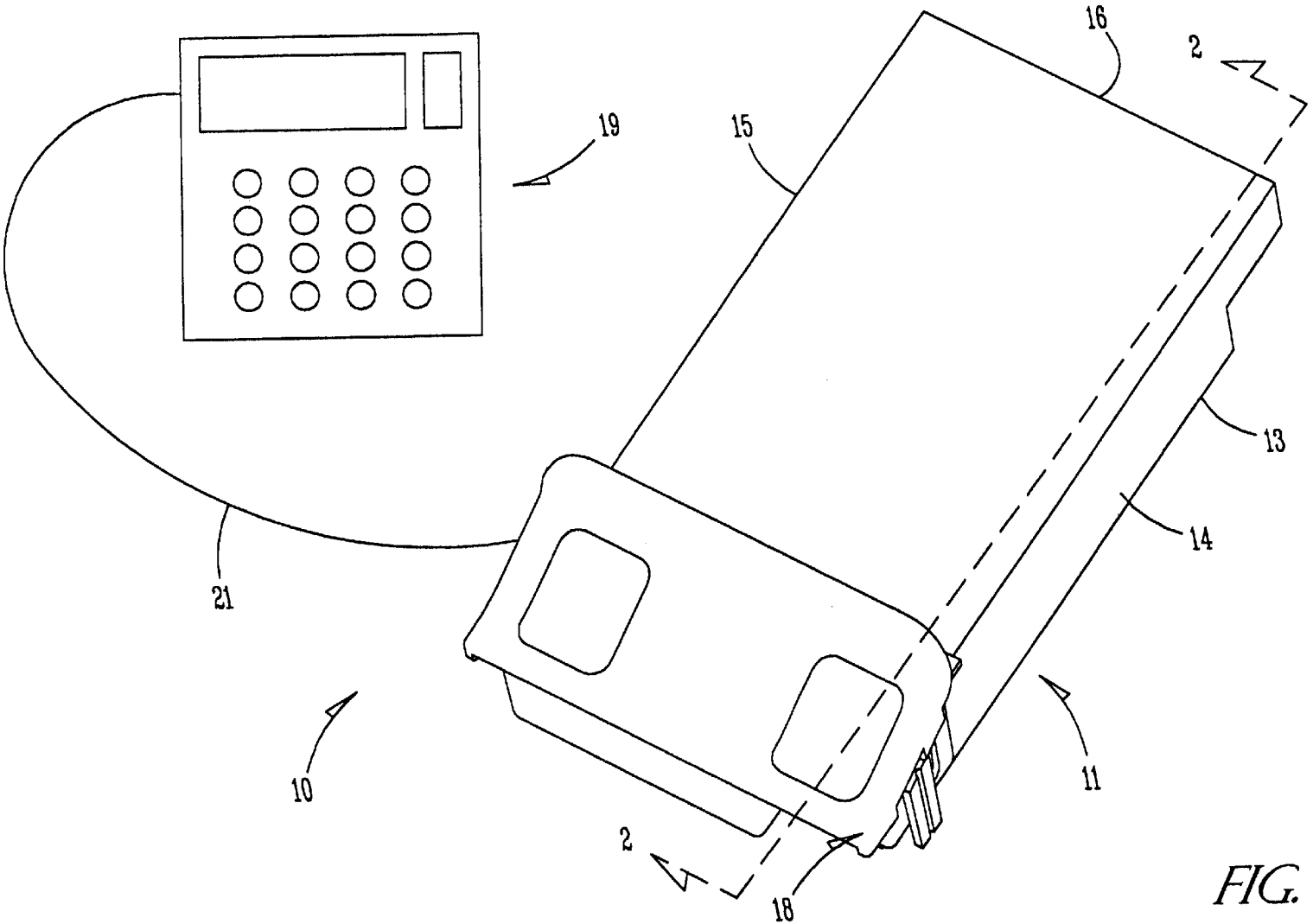
FIG. 1 is a front perspective view of a preferred embodiment of the dispensing apparatus of the present invention that includes a ticket bin together with a keypad and printer assembly.
Figure 2:
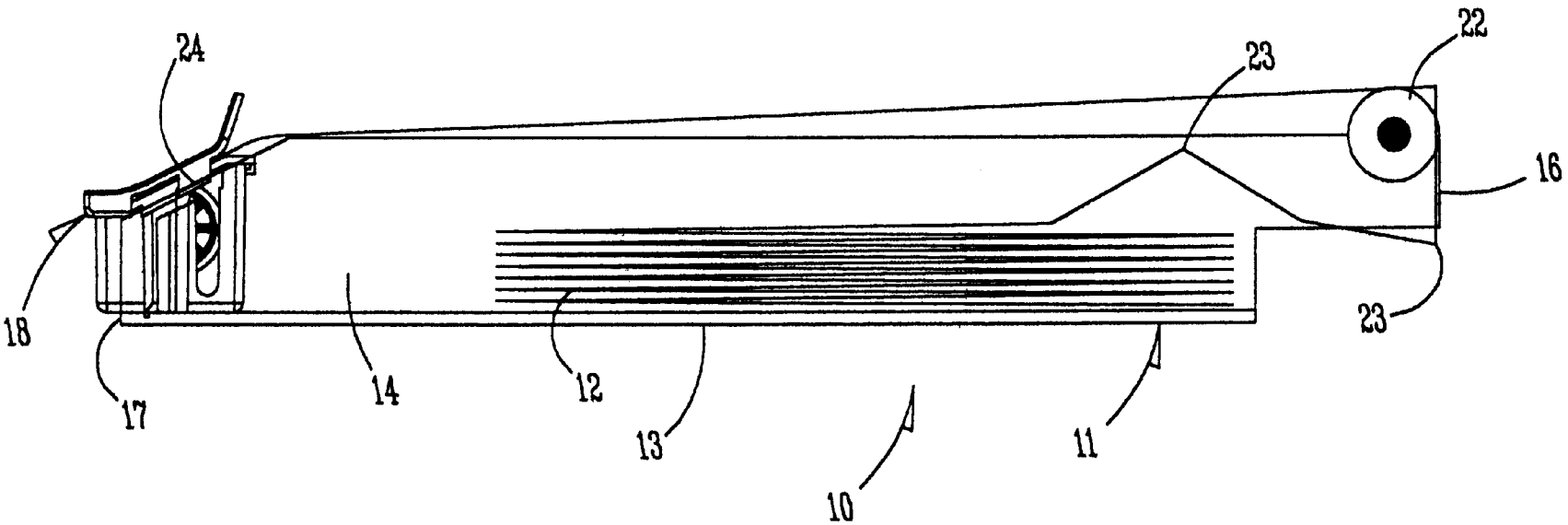
FIG. 2 is a cross-sectional view of the apparatus of FIG. 1 taken along the line 2—2 of FIG. 1.

The present invention provides an apparatus for the storage, display and dispensing of tickets and for the accounting of the tickets dispensed from the apparatus. Referring first to FIGS. 1 and 2, a preferred embodiment of the apparatus of the present invention is shown generally at 10 and is in the form of a generally rectangularly shaped bin 11 in which a pack of lottery tickets 12 (shown only in FIG. 2) is stored for the purpose of being dispensed therefrom. The bin 11 is not typically used by itself but instead is combined with a plurality of other bins 11 in a side-by-side and/or stacked relationship, with the plurality of bins 11 being enclosed in a transparent cover (not shown) to provide a ticket dispenser that contains lottery tickets for a variety of games.

The bin 11 includes a bottom wall 13, sidewalls 14 and 15 having rear ends that are stair-stepped, an open back end 16 and an open front end 17 for receiving a tear bar bin assembly 18. The bin 11 is used in conjunction with a master controller unit 19 in a separate housing that is electronically connected to the bin 11 via cable 21.

Located in the rear portion of the bin 11 is a guide roller 22 that is rotatably attached between the sidewalls 14 and 15. The lottery tickets 12 are in the form of a fanfold pack with the tickets 12 sequentially connected together by perforated joinder lines 23 that define the side edges of each ticket 12.

As shown in FIG. 2, the tickets 12 are trained around the guide roller 22 and extend along the top of the bin 11 to the tear bar bin assembly 18 so as to be displayed for viewing by potential customers. As is well-known in the art, when the bin 11 is utilized in combination with a plurality of other similar bins, all of which are secured in a housing with a preferably transparent top and front, the tickets 12 of the uppermost bins can be viewed by customers for attracting attention to the lottery games being offered in addition to serving as a means for providing a display of the tickets 12, of each game.

Figure 3:
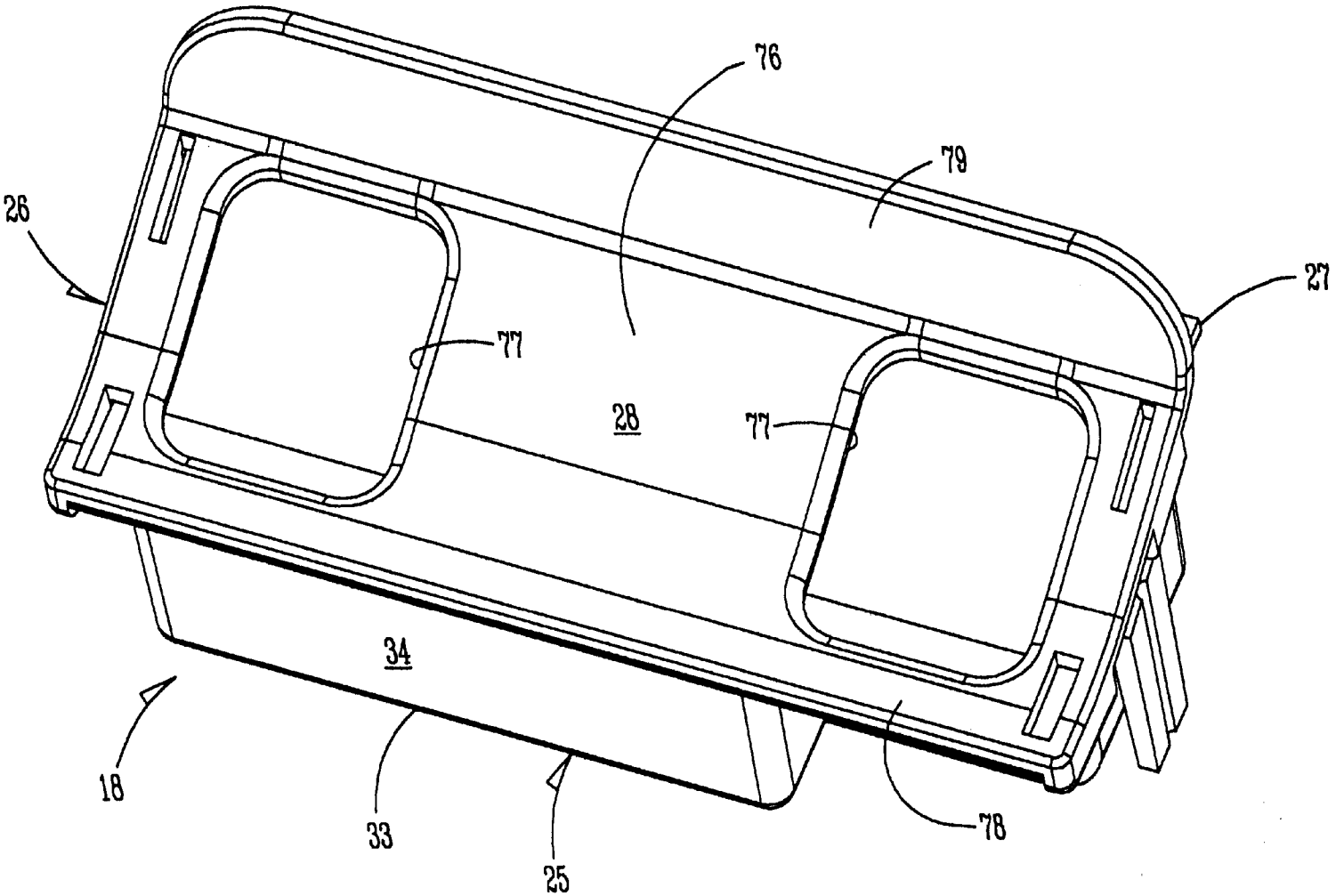
FIG. 3 is a perspective view of a tear bar bin assembly included in the apparatus of FIG. 1.
Figure 4:
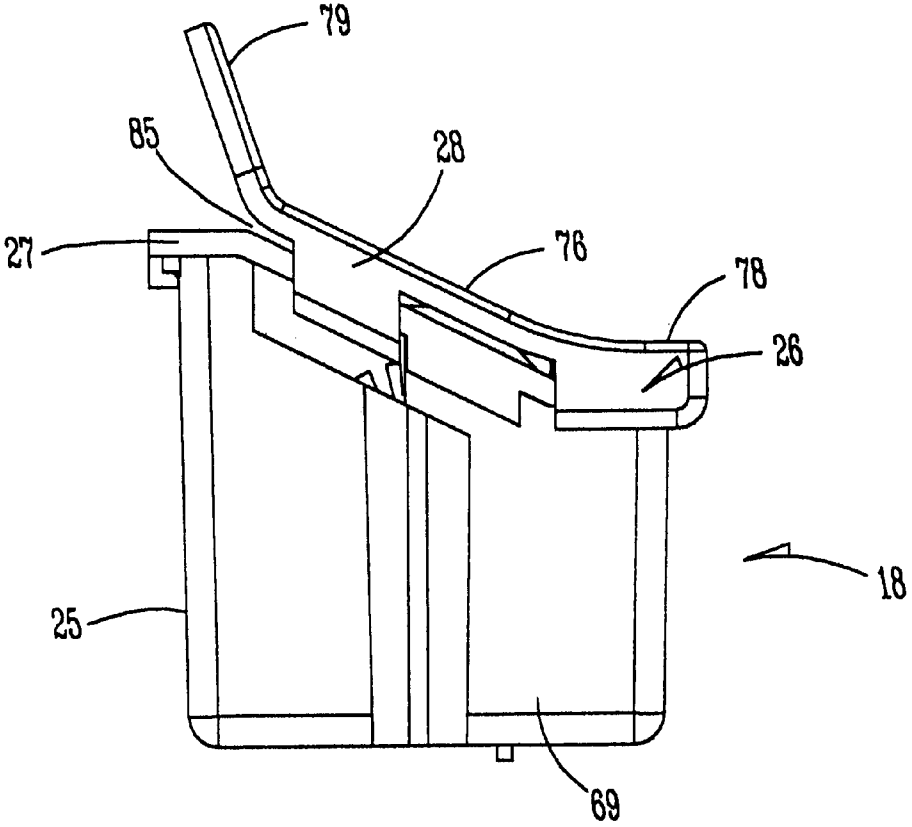
FIG. 4 is a side view in elevation of the bin assembly of FIG. 3.

A leading ticket 24 of the tickets 12 is threaded into the tear bar bin assembly 18 in a position for being dispensed. The tear bar bin assembly 18 serves as a ticket dispensing assembly and, as shown in FIGS. 3 and 4, is preferably formed with a base portion 25 and a two piece cover 26 that includes a lower guide ramp 27 and an upper guide ramp 28 that together serve as a guide means for the tickets 12 to control their travel so that they are maintained in a position for proper counting and verification of counting as will be described below.

Figure 5A:
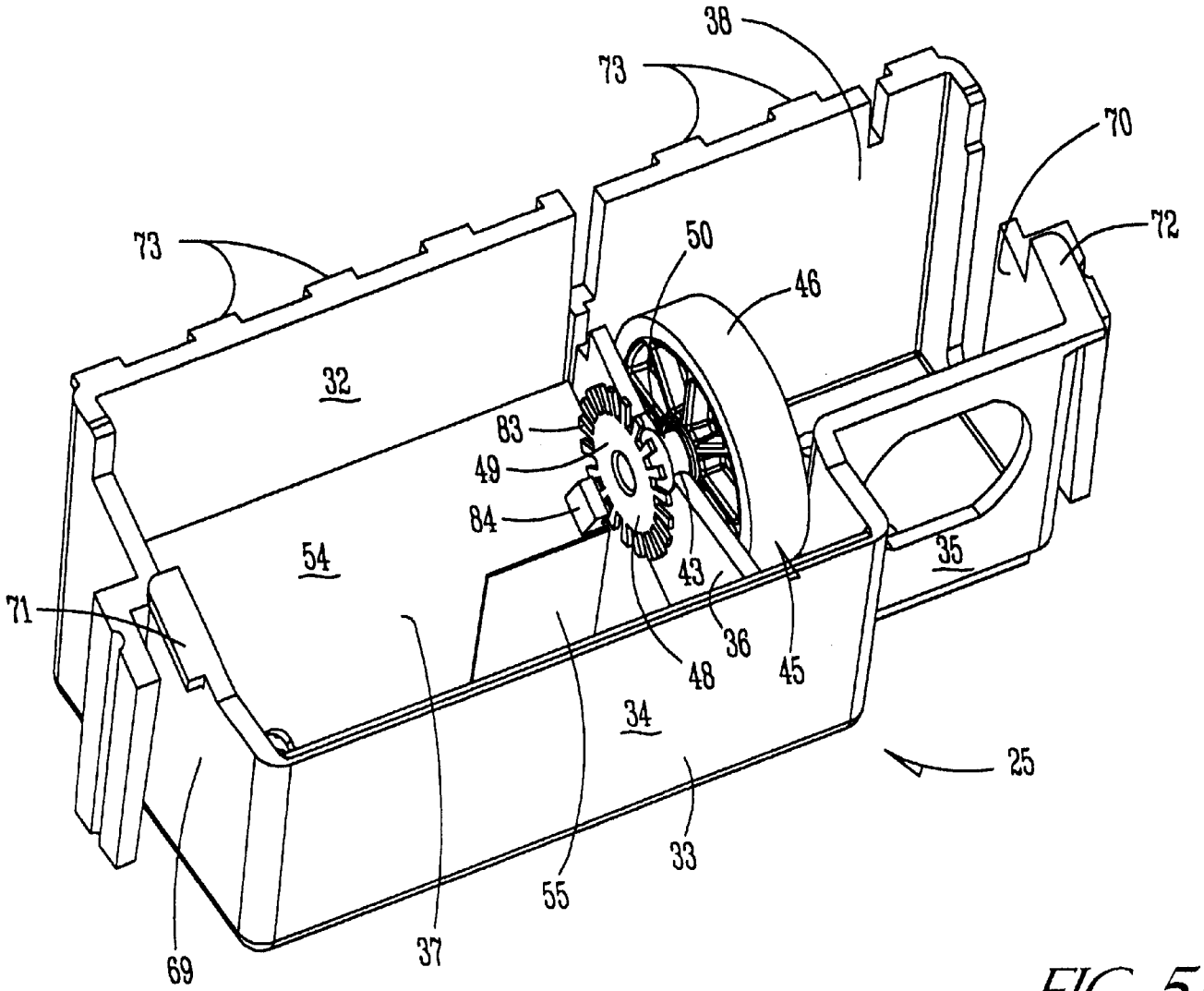
FIG. 5*a* is a perspective view of a base that forms part of the bin assembly of FIG. 3.
Figure 5B:
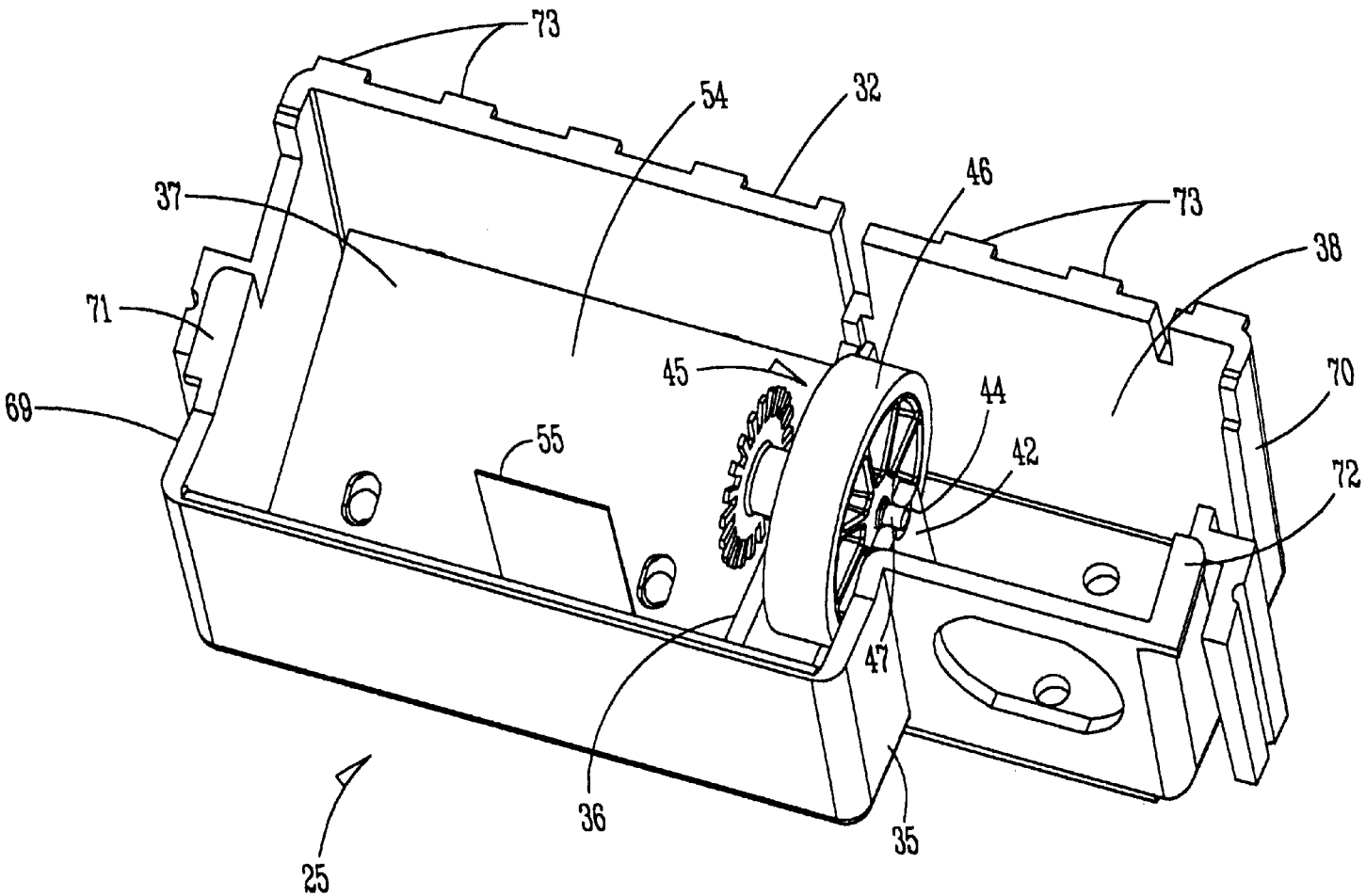
FIG. 5*b* is a second perspective view of the base of FIG. 5*a;*

Referring now to FIGS. 5*a* and 5*b*, the base 25 is generally tray shaped with a relatively straight back wall 32 and a front wall 33 with a straight portion 34 and a stair-stepped portion 35. Connecting between the front wall 33 and the back wall 32 is a cross member 36 that serves to partition the base 25 generally into a large base portion 37 and a smaller base portion 38. As shown only in FIG. 5*b*, projecting upward from the bottom of the base 25 is a strut 42 that is spaced apart from the partition 36. Both the upper portions of the partition 36 and the strut 42 have small arcuate recesses 43 and 44 respectively whereby the partition 36 and the strut 42 serve as trunnions for a friction wheel assembly 45.

Forming the assembly 45 is a friction wheel 46 having a medial axle 47 on one side and an encoder wheel assembly 48 on the opposite side, which assembly 48 includes an encoder wheel 49 and a hub 50. The hub 50 fits in the recess 43 and the axle 47 fits in the recess 44 so that the friction wheel assembly 45 is rotatably supported by the partition 36 and the strut 42.

The large base portion 37 accommodates a printed circuit board 54 that contains the electronics (not shown) for the apparatus 10. Extending vertically upward from the printed circuit board 54 is a piezo electric sensing element 55, which as known in the art produces an electrical signal as a result of its movement. The purpose of the element 55 will be described below.

Figure 6:
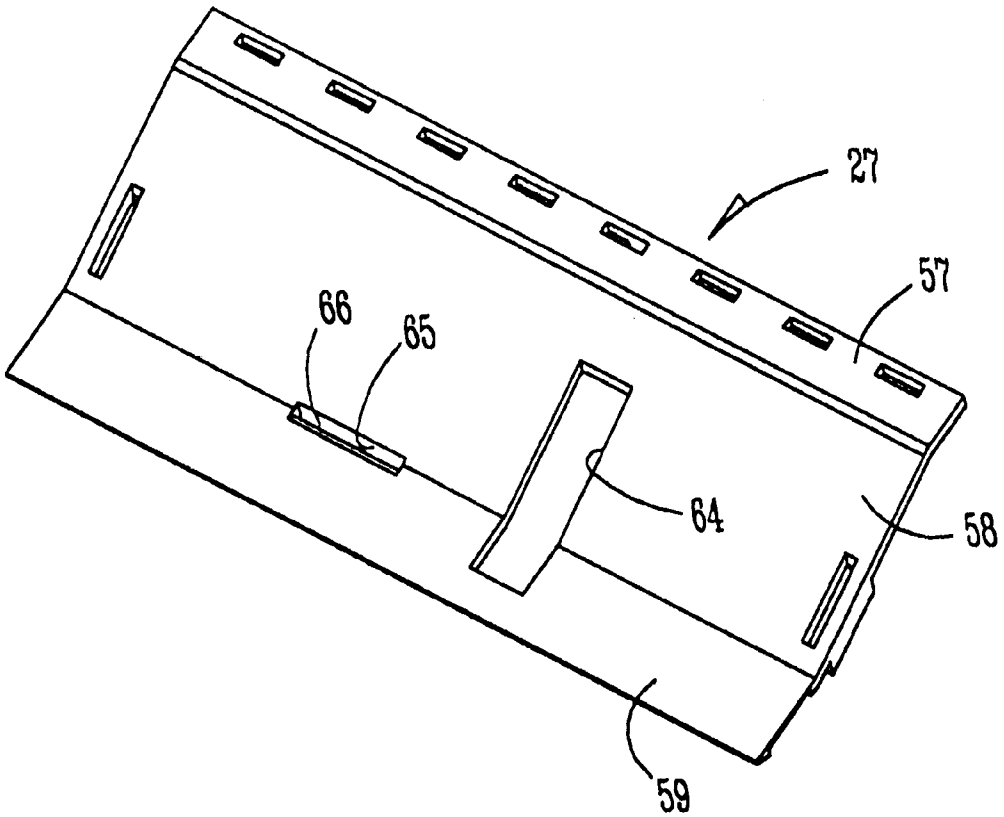
FIG. 6 is a perspective view of a lower ramp of the cover of FIG. 3.
Figure 7:
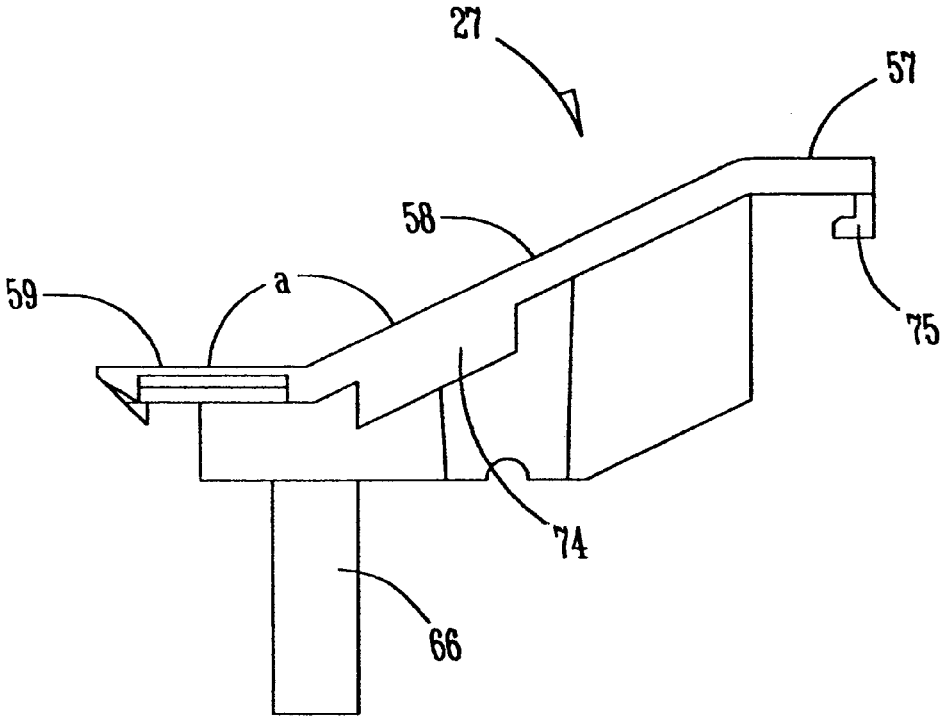
FIG. 7 is an end view in elevation of the lower ramp shown in FIG. 6.
Figure 8:
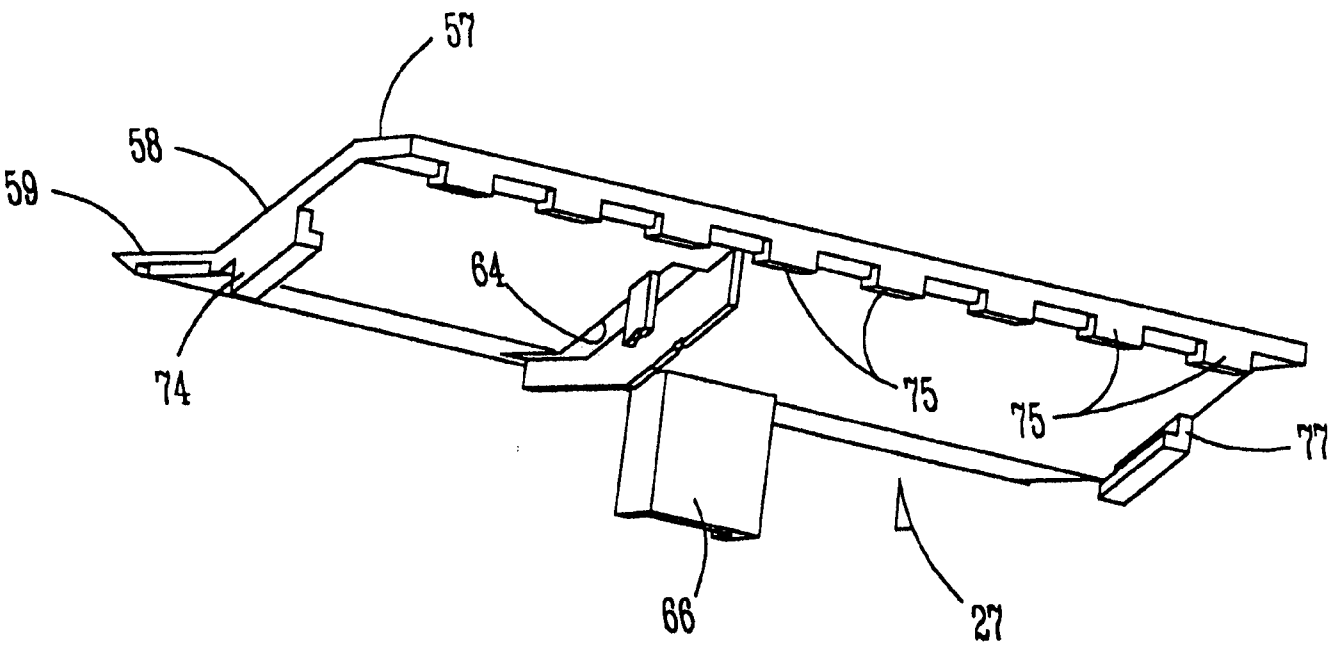
FIG. 8 is a bottom perspective view of the lower ramp of FIG. 6.
Figure 12:
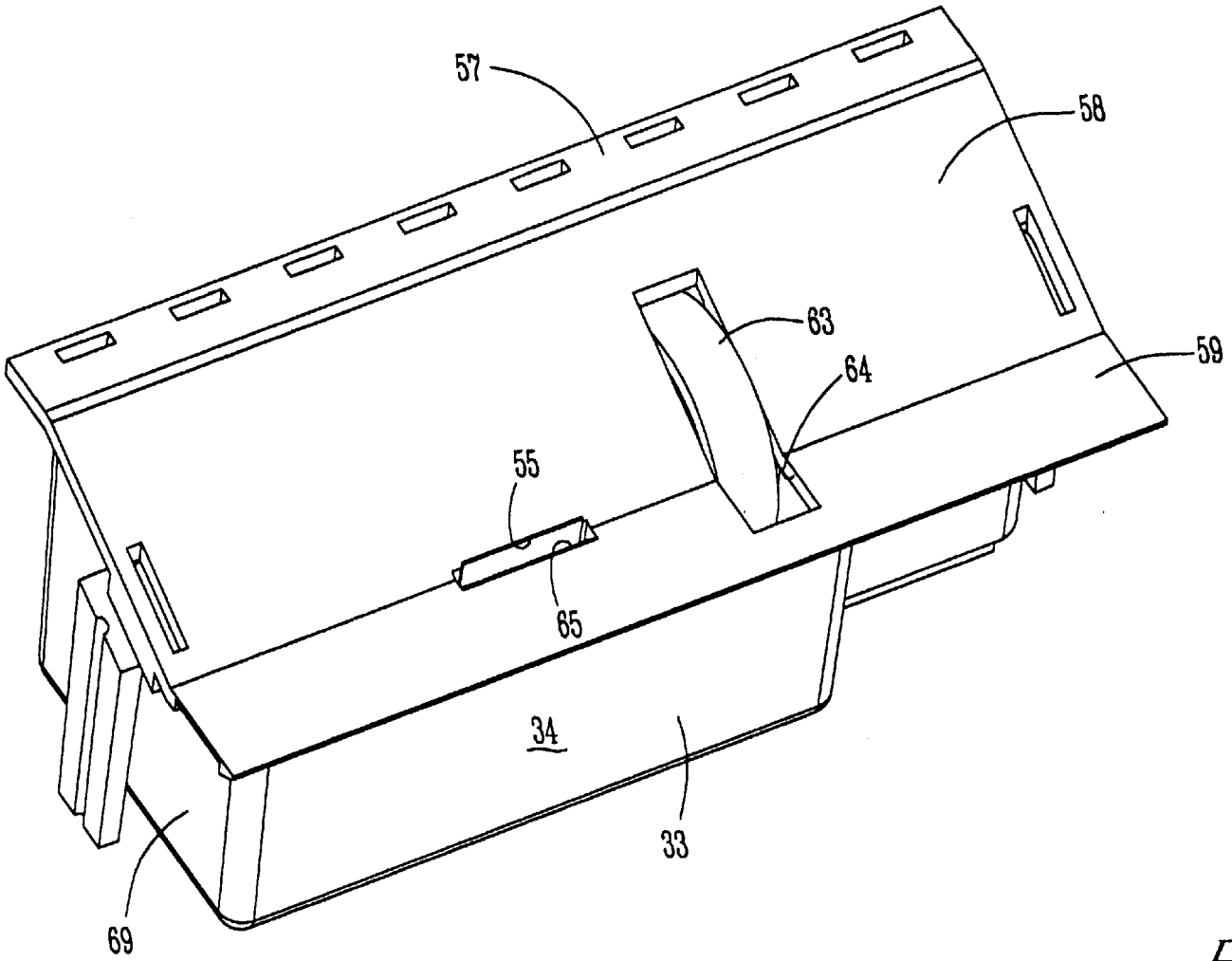
FIG. 12 is a top perspective view of the tear bar bin assembly with only the lower ramp of the cover mounted thereon.

Referring now to FIGS. 6, 7 and 8, the lower guide ramp 27 of the cover 26 is formed of three planer portions including a narrow top portion 57, a relatively wide middle portion 58 and a third lower portion 59. The top and lower portions 57 and 59 lie in planes generally parallel to that of the bottom of the bin 11, and the middle portion 58 is inclined with respect thereto on an angle alpha of preferably approximately one hundred fifty-four degrees, for a purpose as will be described below. Formed in the lower ramp 27 is a slot 64 aligned traversely to the longitudinal axis of such ramp and of a size corresponding to slightly larger than the friction wheel 46. Thus, the upper portion of the friction wheel 46 can extend partially through the slot 64, as indicated in FIG. 12, when the tear bar bin assembly 18 is fully assembled.

The lower guide ramp 27 also includes a narrow slit 65 (shown only in FIG. 6) that is aligned with the piezo electric element 55 to permit the upper portion of such element to extend therethrough for a purpose as will be described below. A chute 66 extends downwardly from below the slit 65 and is open on one side so that it only partially encloses the element 55 to permit the element 55 to bow when it comes in contact with the perforations of the tickets 12.

To connect the lower ramp 27 to the base 25, the base has end walls 69 and 70 with upper side ledges 71 and 72 that extend outwardly therefrom, and back ledges 73 that extend outwardly from the base back wall 32. The ledges 71, 72 and 73 all come into engagement with side flanges 74 and back flanges 75 that depend from the bottom surface of the lower ramp 27 to hold it in place on the base 25. Thus, the lower ramp 27 can be quickly and easily assembled on the base 25 by slidably engaging the flanges 74 and 75 of the lower ramp 27 with the ledges 71, 72 and 73 of the base 25.

Figure 9:
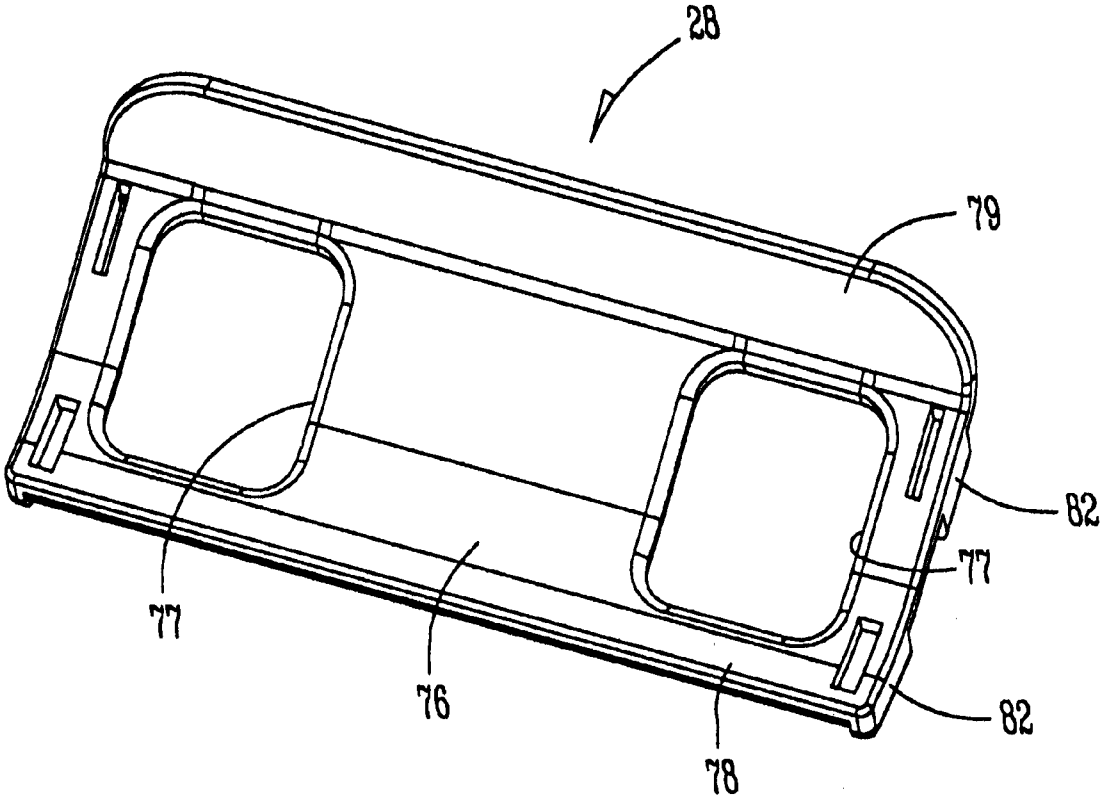
FIG. 9 is a top perspective view of an upper ramp that forms part of the cover shown in FIG. 3.
Figure 10:
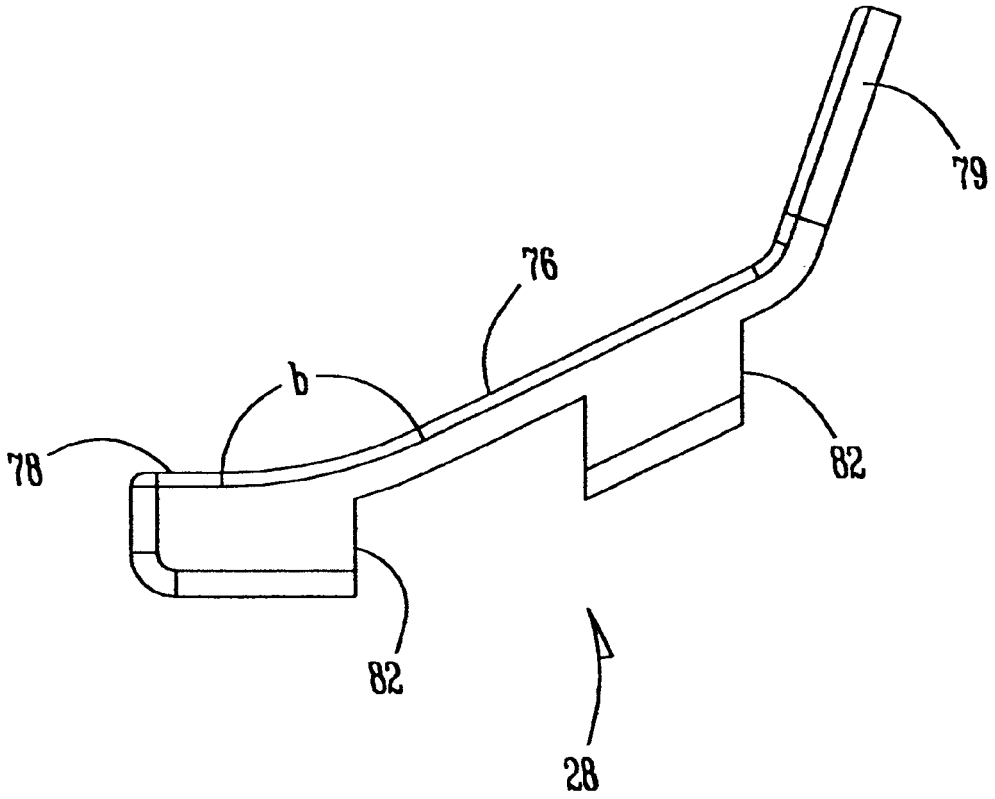
FIG. 10 is an end view in elevation of the upper ramp of FIG. 9.
Figure 11:
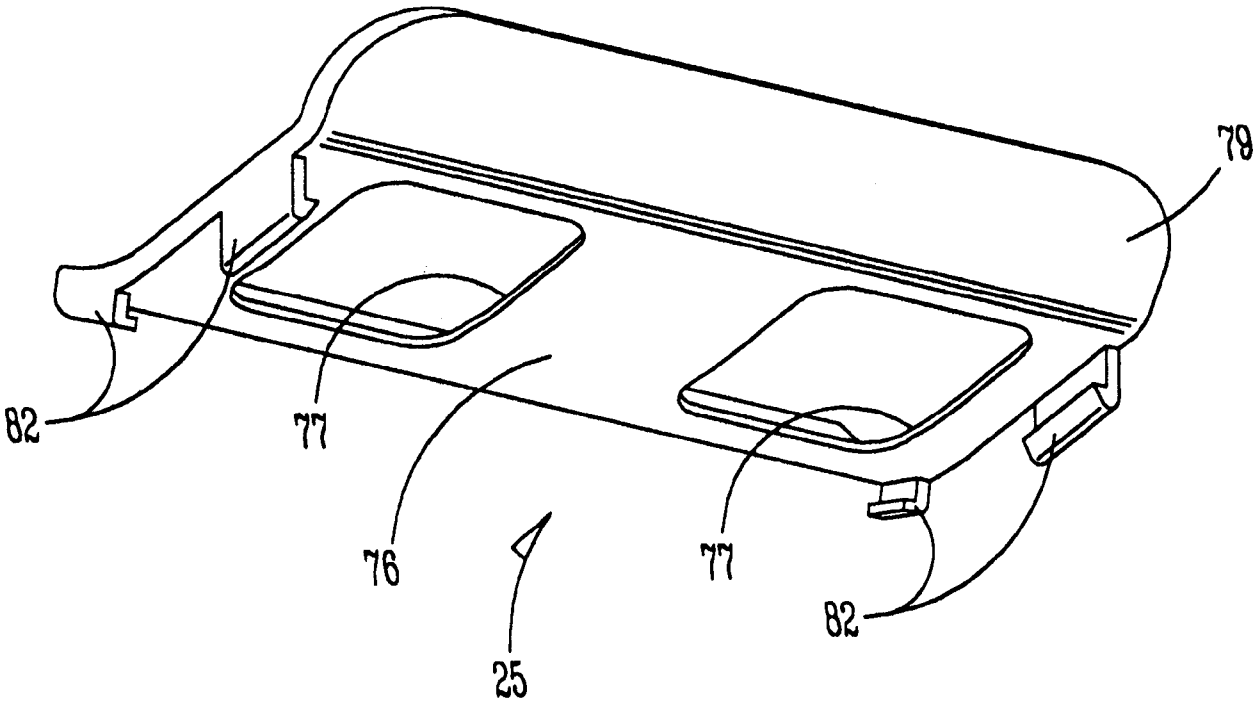
FIG. 11 is a bottom perspective view of the upper ramp of FIG. 9.

Referring now to FIGS. 9, 10 and 11, the upper guide ramp 28 of the cover 26 has a middle planer portion 76 that generally conforms to the shape of the middle portion 58 of the lower ramp 27 and has a pair of open windows 77 that allow a user to touch any lottery ticket 12 retained within the tear bar bin assembly 18. Similar to the lower ramp 27, the upper ramp 28 has a lower portion 78 that forms an angle beta with the middle portion 76 comparable to the angle alpha formed by the middle and lower portions of the lower ramp 27.

The side edges of the upper ramp middle portion 76 have downwardly depended L-shaped flanges 82 that are sized for engagement with the side edges of the lower ramp 27 for assembly of the two ramp portions 27 and 28 together to form the cover 26.

The upper guide ramp 28 further includes an upper portion 79 that extends generally in a direction perpendicular to the bin bottom wall 13. Thus, when the ramps 27 and 28 are assembled together, their top segments form a guiding funnel type structure to direct the end most ticket 24 between the ramps 27 and 28, which when attached together, form a narrow passageway 85 (see FIG. 4) through which the tickets 12 can be guided and directed for dispensing from the apparatus 10. As the tickets 12 pass through the tear bar bin assembly 18 to be dispensed, they engage the friction wheel assembly 45 and the piezo electric element 55 to provide a counting operation of the tickets dispensed for the apparatus 10 as will now be described.

The counting operation of the apparatus 10 is principally dependent upon the frictional engagement of the friction wheel 46 with the tickets 12. Movement of the tickets 12 through the tear bar bin assembly 18 causes rotation of the friction wheel assembly 45, including the encoder wheel 49 to provide ticket dispensing information to the electronic circuitry of the apparatus 10 located on the printer circuit board 54.

As can be best seen in FIG. 5A, the encoder wheel 49 is of a spoked configuration 83 and is positioned between a light emitting diode and two optical sensors of an emitter detector assembly 84 which serves to translate rotation of the friction wheel 46 into electronic signals indicative of the number of lottery tickets that are dispensed from apparatus 10. By using the emitter detector assembly 84 with two optical sensors the leading and trailing edges of the encoder wheel spokes 83 can be sensed in order that the apparatus 10 can distinguish between the direction of movement of the tickets 12. Thus, the use of the encoder wheel 49 provides a means of measuring ticket travel through the tear bar bin assembly 18 via the use of a plurality of counts for each inch of rotation of the friction wheel 46 so that a highly precise measurement is provided through the small increments being measured.

Figure 14:
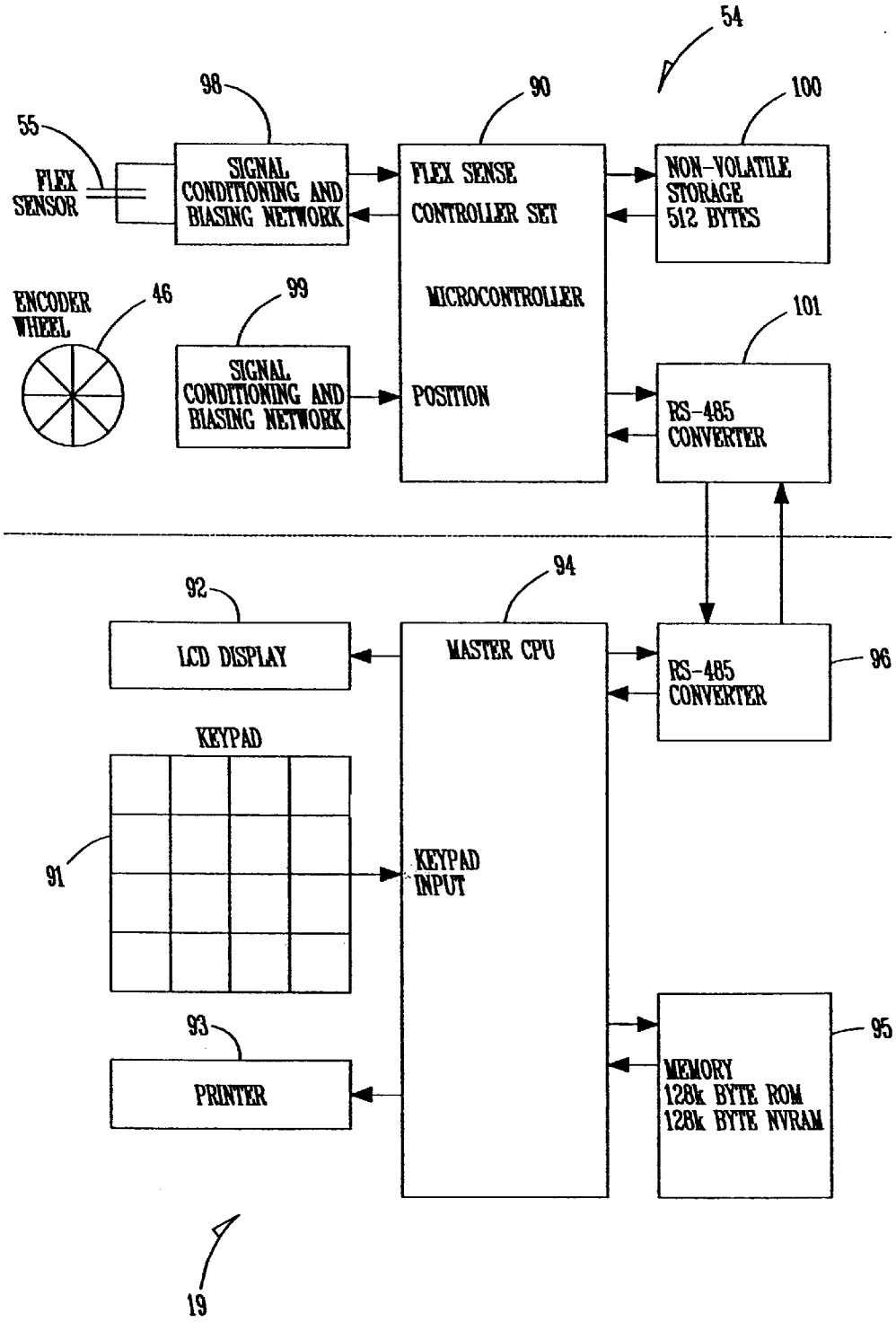
FIG. 14 is a block diagram of the electrical circuitry of the apparatus of FIG. 1.

The friction wheel assembly 45 is, in the first instance, the principal means for counting the tickets 12 as they are dispensed from the apparatus 10. Prior to dispensing of any of the tickets 12 from the bin 11, information about the tickets 12 is programmed into a microcontroller 90 included on the printed circuit board 54 through the use of the master controller 19, as indicated in the block diagram of FIG. 14. The master controller 19 has a keypad 91 with a liquid crystal display 92 for performing this programming, which includes the type of game the tickets 12 are for, the ticket length and the number of tickets 12 in the pack.

The master controller 19 further includes a printer 93, a master central processing unit 94, memory storage means 95 and a RS485 converter 96 for communicating with the electronics of the bin 11 which are located in the tear bar bin assembly 18 and co-act with the encoder wheel 49 and the flex sensor 55. Associated with the microcontroller 90 are signal conditioning and biasing networks 98 and 99 for the encoder wheel 46 and the sensor 55 respectively, a memory storage means 100 and a RS485 converter 105 all located on the printed circuit board 54.

The master CPU 94 has the functions of monitoring the bin microcontrollers 90 of a plurality of bins 11 for ticket dispensing activity, recording such activity in non-volatile memory, allowing printouts of sales and auditing reports, and system administration tests such as loading bin counts, assigning PIN numbers, etc. The master CPU 94 poles each of the bin microcontrollers 90 via two synchronous serial buses using a compact protocol to allow for high speed operation. The bin microcontroller 90 is responsible for keeping a real time count and reporting back incremental numbers of tickets dispensed, which are then recorded by the master CPU 90 and subtracted from the inventory.

With the length of the lottery tickets 12 programmed into the microcontroller 90, it is a simple matter for translation of the measurements provided by the friction wheel assembly 45 into the number of lottery tickets dispensed during any desired time period. Preferably, to insure that a ticket is counted accurately, it is desirable that the microcontroller 90 will have a forward and reverse allowance in its ticket count so that a ticket does not have to be at its exact end point before it will be counted. This allowance is similar to a tolerance in that it allows for a ticket to be counted at a point slightly plus or minus of its end point to increase the accuracy of the ticket count. In view of the small margin of profit a retailer is provided for the sale of lottery tickets it is essential for the accuracy of the apparatus 10 to be essentially error free. The use of the friction wheel assembly 45 by itself, does not provide error free count due to variation in ticket length and mechanical variations. This is the reason for the use of the piezo electric element 55 that is utilized to serve as a second ticket counting means. By the use of the element 55 the accuracy of the apparatus 10 is increased so as to be virtually error free.

In operation, the piezo electric element 55 is utilized as a resetting of the count provided by the friction wheel assembly 45. Due to variations in the length of the tickets 12 and mechanical variations it is possible that the count provided by the friction wheel assembly 45 will not be accurate. Although any error will be slight for the measurement of a single ticket 12, if the count provided by the assembly 45 is not reset or calibrated at periodic intervals, the error can accumulate as multiple tickets 12 are dispensed until the error reaches the point that it affects the accuracy of the ticket count.

In view of the fact that the piezo electric element 55 operates based upon a sensing of the perforations 23 of the tickets 12 rather than a measurement of such tickets, the accuracy of the counting information provided by the element 55 is not affected by any mechanical variance between the friction wheel assembly 45 and the tickets 12. To insure that sensing of the ticket perforations 23 is likely to occur by the piezo electric element 55, two elements of the bin 11 are of critical importance.

Firstly, the roller 22 in the back of the bin 11 not only serves as a guide function for the tickets 12, but additionally causes the perforations 23 to be opened as the tickets 12 pass around the roller 22 at an angle to one another to extenuate the perforations 23. Equally important in this process is the ramp configuration of the tear bar assembly cover 26 and the angle alpha formed by the middle and lower portions 58 and 59 respectively of the lower ramp 27. Because of this configuration the tickets 12 are bent with respect to one another as they travel through the passageway 85 to attenuate the perforations 23 therebetween. Although the size of the angle alpha is preferably approximately one hundred fifty-four degrees, such angle can range between one hundred five degrees and one hundred seventy-four degrees for proper ticket sensing. The one hundred fifty-four degree angle is only preferable in that it provides an optimum relationship between the ease of ticket dispensing and maximum perforation extenuation.

Because the piezo electric element 55 is not utilized to provide an actual count of the tickets 12, but only serves to reset the count provided by the friction wheel assembly 45, it is not essential that the element 55 sense each perforation 23. Nevertheless, it is important for proper operation of the apparatus 10 that the element 55 provide a reset of the count of the friction wheel assembly 45 as a result of the actual sensing of a perforation 23. Accordingly, the electronic circuitry of the microcontroller 90 includes a number of safeguards to insure that the friction wheel assembly count is reset only when the element 55 has properly sensed a ticket perforation 23.

Figure 13:
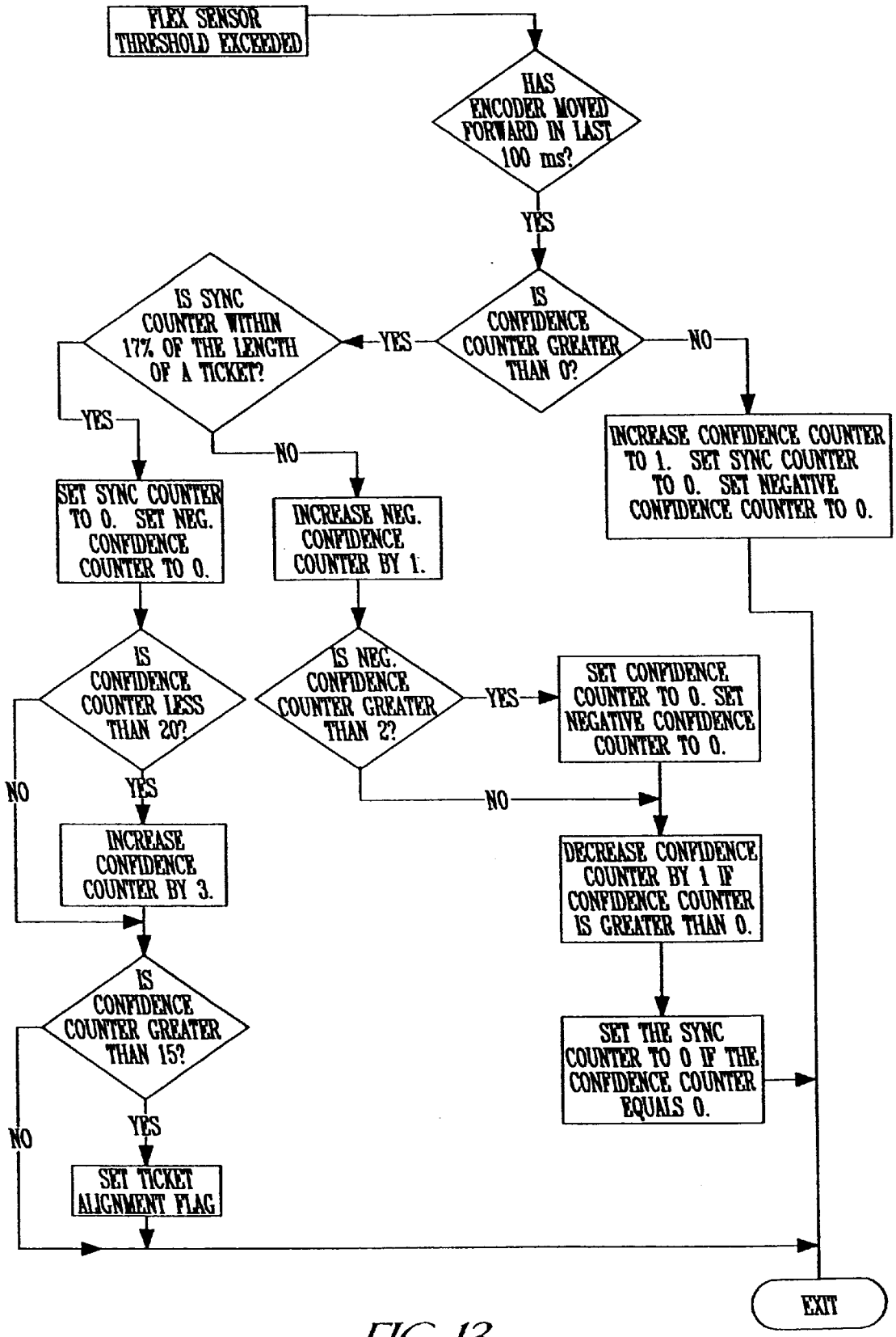
FIG. 13 is a flow chart showing the manner in which a ticket sensing count is produced by the apparatus of FIG. 1.

The safeguards include the use of a sync counter to permit resetting of the count of the friction wheel assembly 45 only if the element piezo electric 55 has sensed a perforation at a time when the sync counter indicates that it is within seventeen percent of the length of a ticket, a confidence counter that must have a confidence level of greater than fifteen to permit resetting, and a negative confidence counter, all of which counters are provided by the microcontroller 90. Also, resetting of the ticket count will only occur if the friction wheel assembly 45 has moved forward in the last one hundred milliseconds when the element 55 indicates the sensing of a perforation 23. The particular flowchart preferred for providing these safeguards in an efficient and effective manner is shown in FIG. 13. By utilizing these various safeguards, accuracy of the apparatus 10 is increased to virtually be error free.

Thus, the present invention provides a novel and efficient ticket dispensing apparatus for accurately detecting and counting the number of tickets dispensed from the apparatus. Although the present invention has been described with respect to a preferred embodiment, it should be understood by those skilled in the art that such embodiment may be altered without departing from the true spirit and scope of the invention.

What is claimed is:

1. An apparatus for the storage, display and dispensing of tickets, said apparatus comprising:

(a) a bin housing for storing a pack of tickets sequentially connected together by perforated joinder lines that define the edges of each ticket, said bin housing including a dispensing end and an opposite end;

(b) a ticket dispensing assembly located at the dispensing end of said bin housing and having a ticket dispensing slot through which said tickets are dispensed from said bin housing;

(c) a ticket sensing means associated with said dispensing assembly and including a piezo electric sensor that detects the perforations of the tickets as they pass through said dispensing assembly; and (d) wherein said dispensing assembly includes a cover with top plate and a bottom plate closely aligned together to form a narrow slot therebetween through which said tickets pass through for sensing thereof, which slot is of an angled configuration to improve the sensing of said tickets by said piezo electric sensor.

2. A dispensing apparatus as recited in claim 1, wherein said dispensing assembly further includes a tray shaped base with an open top on which said cover is located and said piezo electric sensing element is located in said base and extends into the slot of said cover.

3. A ticket dispensing apparatus as recited in claim 2, wherein said bottom plate of said cover includes an aperture and said sensing means extends through said aperture to engage said tickets.

4. A ticket dispensing apparatus as recited in claim 1, wherein said top and bottom plates of said cover are formed with portions that are at an angle to one another, which angle is in the range of one hundred five degrees to one hundred seventy-four degrees.

5. A ticket dispensing apparatus as recited in claim 4, wherein said angle of said top and bottom plate portions is in the range of one hundred fifty degrees to one hundred sixty degrees.

6. A ticket dispensing apparatus as recited in claim 3, wherein said aperture in said bottom plate is located proximate to the vertex of said angle.

7. A ticket dispensing apparatus as recited in claim 2, wherein said bottom plate of said cover has side flanges and said base has side edges which co-act together for attaching said bottom plate to said base.

8. A ticket dispensing apparatus as recited in claim 7, wherein said top plate includes flanges for engaging the side edges of said bottom plate for securing said plates together.

9. A ticket dispensing apparatus as recited in claim 1, wherein said top plate includes at least one opening through which contact can be made with said tickets in said ticket dispensing slot.

10. A ticket dispensing apparatus as recited in claim 1, wherein said dispensing assembly is in the form of a tear bar.

11. A ticket dispensing apparatus as recited in claim 1, wherein a guide means is located in the opposite end of said bin housing and said tickets are trained around said means to accentuate the perforations therebetween.

* * * * *